US006447147B1

(12) United States Patent
Kramer et al.

(10) Patent No.: US 6,447,147 B1
(45) Date of Patent: Sep. 10, 2002

(54) LIGHTING APPARATUS WITH APERTURED CONVEX INNER REFLECTOR

(75) Inventors: Arthur I. Kramer, Bristol; Lawrence A. Gattegno, East Providence; Brian L. Kinnune, Newport; Peter B. van Colen, Tiverton, all of RI (US)

(73) Assignee: Kramer Lighting, Inc., Middletown, RI (US)

( * ) Notice: Subject to any disclaimer, the term of this patent is extended or adjusted under 35 U.S.C. 154(b) by 0 days.

(21) Appl. No.: 09/650,252

(22) Filed: Aug. 29, 2000

(51) Int. Cl.[7] ..... F21V 7/00

(52) U.S. Cl. ..... 362/297; 362/304; 362/346; 362/241; 362/260; 362/225

(58) Field of Search ..... 362/297, 304, 362/346, 241, 247, 260, 225, 216

(56) References Cited

U.S. PATENT DOCUMENTS 5,197,798 A 3/1993 Tickner
5,355,290 A 10/1994 Tickner
5,377,086 A 12/1994 Tickner
5,473,522 A 12/1995 Kriz et al.
5,803,592 A * 9/1998 Lawson ..... 362/300
RE36,414 E 11/1999 Tickner

FOREIGN PATENT DOCUMENTS

GB 878534 10/1961

* cited by examiner

*Primary Examiner*—Alan Cariaso
*Assistant Examiner*—Ronald E. DelGizzi
(74) *Attorney, Agent, or Firm*—Jansson, Shupe & Munger, Ltd.

(57) ABSTRACT

A lighting apparatus is provided including a main reflector member having a primary axis and an inner reflective surface for reflecting light to an area to be illuminated; a supplemental reflector member which also serves as a socket cover, smaller than the inner surface of the main reflector member, removably attached with respect to the inner surface of the main reflector member; and a light source configured and arranged such that a portion of the light emitted from the source will be reflected by the supplemental reflector member to the inner reflective surface of the main reflector member for reflection to an area to be illuminated.

19 Claims, 5 Drawing Sheets

LIGHTING APPARATUS WITH APERTURED CONVEX INNER REFLECTOR

FIELD OF THE INVENTION

This invention is related generally to light fixtures, and in particular, to a light fixture having an improved reflector for directing light therefrom.

BACKGROUND OF THE INVENTION

Electrically-generated artificial light from lighting fixtures of various kinds is used for lighting large indoor spaces, such as in factories, warehouses, other commercial spaces and elsewhere. Providing excellent levels of illumination with minimal energy costs is a continuing important objective. As the cost of materials to produce the fixtures and lamps has increased and the cost of energy to run the fixtures has increased, it is important for end users to satisfy lighting needs, if possible, with fewer fixtures and less energy consumption.

A step toward energy economy is taken by the use of compact fluorescent lamps which are more energy efficient and relatively inexpensive when compared to other types of lamps.

Open-ended light fixtures (i.e. those with lamps which are not fully enclosed within a chamber) allow for direct transmission of light to surfaces to be illuminated without the need to pass through a lens of transparent or translucent material, and thus tend to be more energy efficient than light fixtures with enclosed lamps. Open-ended fixtures are generally preferred for lighting large indoor spaces. Open-ended fixtures tend to be less expensive to produce, are easier to maintain, remain somewhat cooler in operation, and do not lose luminosity to a lens. Given that lamps radiate light multi-directionally, a reflector is typically included in the fixture to capture and redirect light that would otherwise not be useful.

Many open-ended fixtures, especially those fixtures designed to receive one or more compact fluorescent lamps, leave the socket and base visible. While the reflector may be quite ornate, the sockets are designed for functionality and their appearance tends to detract from the aesthetics of the overall fixture. Further, for fixtures which use compact fluorescent lamps, the compact fluorescent lamps radiate generally radially (with respect to their lengths) regardless of their orientations with respect to the target area to be illuminated; therefore a significant portion of the light emitted from such lamps may not be efficiently used.

Certain prior art open-ended light fixtures have a plurality of compact fluorescent lamps arranged for efficient light dispersion and provide an alternative to light fixtures having high intensity discharge lamps. An example of a open-ended light fixture is provided in U.S. Pat. No. 5,377,086 (Tickner). The light fixture disclosed in the Tickner '086 patent has several lamps which are inclined to be generally parallel to the concave surface of the reflector. Such configuration has aesthetic shortcomings because the socket structure and apparatus are exposed. Furthermore, such device has certain light loses by virtue of the fact that there is no light reflectance from the central region of the fixture.

There is a need for improved open-ended lighting fixtures which provide high efficiency in the use of light and which have improved aesthetics. There is also a need for improvement for light fixtures of the type which have plural compact fluorescent lamps as opposed to a single high intensity discharge lamp.

OBJECTS OF THE INVENTION

It is an object of this invention to provide an improved lighting apparatus overcoming some of the problems and shortcomings of the prior art.

Another object of this invention is to provide an apparatus which increases the ratio of light emitted from a light source to the light received by a target area to be illuminated.

Another object is to provide a socket cover which will shield from view the sockets which would otherwise be open for inspection.

Still another object of the invention is to provide a socket cover which will direct light to a target area rather than absorb the light.

As another object of this invention, this apparatus will provide an aesthetically pleasing appearance to the fixture.

It is yet another object of this invention to provide a socket cover through which lamps may easily engage and disengage a socket.

Another object of this invention is to increase the useful reflectance of light from a fixture having several lamps.

These and other objects of the invention will be apparent from the following descriptions and from the drawings.

SUMMARY OF THE INVENTION

In accordance with the present invention, an improved lighting apparatus is provided. The lighting apparatus includes a main reflector member with an inner reflective surface for reflecting light to an area to be illuminated; a supplemental reflector member, which is smaller than the inner surface of the main reflector member; and a light source, which is preferably a plurality of electric lamps. The supplemental reflector member is removably attached with respect to the inner surface of the main reflector member. The light source is positioned such that a portion of the light emitted from the source will be reflected by the supplemental reflector member to the inner reflective surface of the main reflector member to the area to be illuminated. It is contemplated that the supplemental reflector member has a reflective surface which is convex.

As stated, while the light source may be a single light-emitting member, it is preferable for the light source to be a plurality of electric lamps which will engage an electricity source with a sufficient number of sockets to accommodate the number of lamps. The electricity source is attached with respect to the main reflector member. It is desirable for the supplemental reflector member to have apertures through which the lamps may be inserted to engage the sockets. In this way, the sockets are shielded from view by the supplemental reflector member and the lamps. The apertures are spaced apart on the surface of the supplemental reflector member in a predetermined grid pattern.

The lighting apparatus may use a compact fluorescent lamp as the at least one light-emitting member. The electricity source will have at least as many sockets as number of compact fluorescent lamps, and at least as many apertures as the number of sockets.

Each compact fluorescent lamp has an axis and the main reflector member has a primary axis. The sockets may be arranged such that when the compact fluorescent lamps are engaged with the sockets, the axes of the compact fluorescent lamps are parallel with each other and parallel with the primary axis of the main reflector. Alternatively, the sockets may be arranged such that when the compact fluorescent lamps are engaged with the sockets, the axes of the compact fluorescent lamps radiate outwardly from the primary axis of the main reflector member.

In accordance with a further aspect of the present invention, the lighting apparatus has a main reflector member with a base end of a first size and a light-emitting end of a second size larger than the first size, a support member attached to the base end of the main reflector member, a plurality of compact fluorescent lamps removably engaged with respect to the support member, and an electric power supply for supplying power to the lamps engaged with respect to the support member. The improvement includes a supplemental reflector member with a convex reflective surface, removably attached with respect to the support member and located within the main reflector member, the supplemental reflector member having apertures through which the lamps can be removably engaged with respect to the support member, configured and arranged such that a portion of light emitted from the lamps will be reflected from the supplemental reflector member to the main reflector member for reflection onto an area to be illuminated.

BRIEF DESCRIPTION OF THE DRAWINGS

The drawings illustrate preferred embodiments which include the above-noted characteristics and features of the present invention and will be readily understood from the descriptions and drawings In the drawings.

DETAILED DESCRIPTION OF PREFERRED EMBODIMENTS

Figure 1:
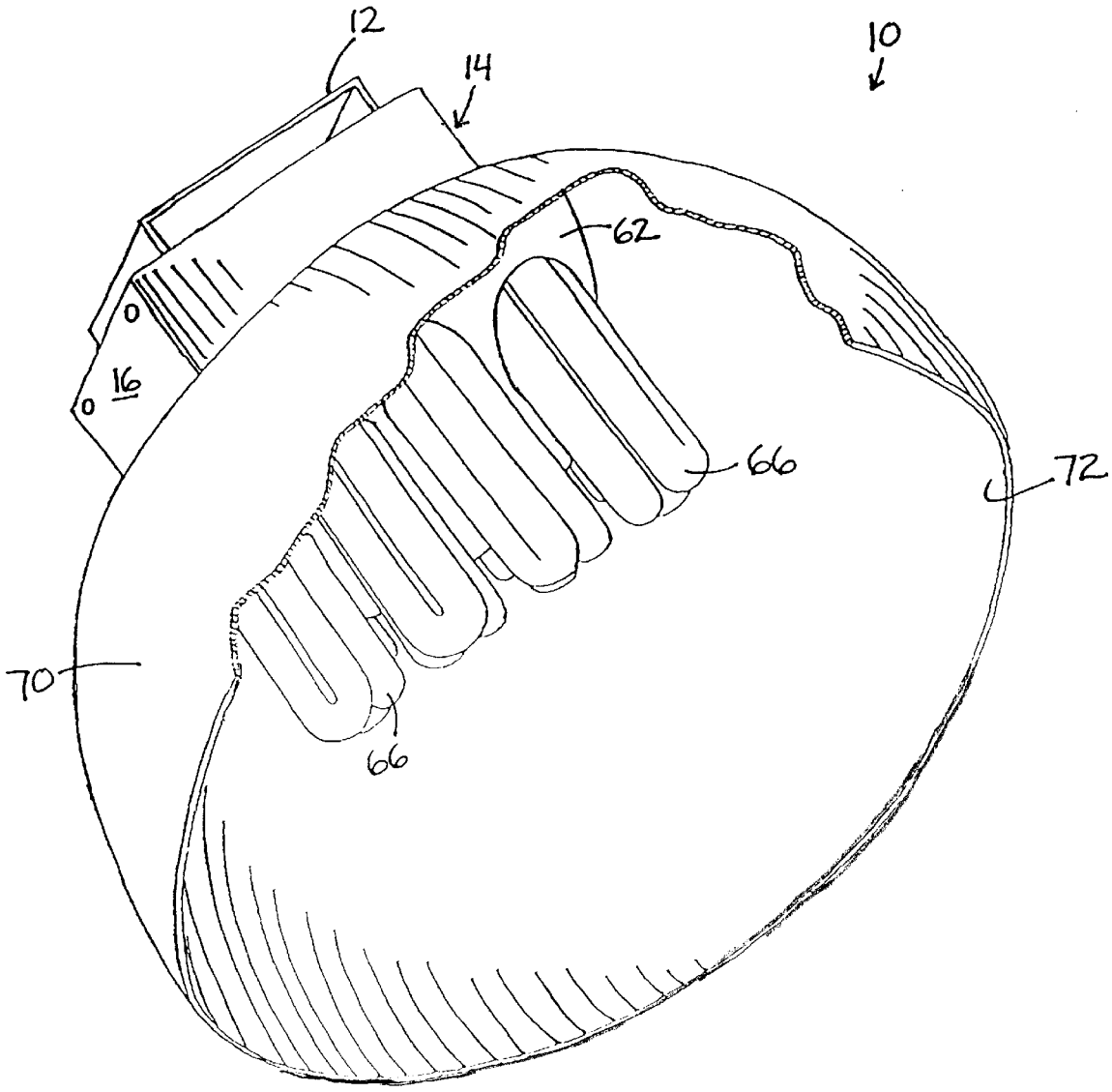
FIG. 1 is a perspective view of a preferred lighting apparatus in accordance with this invention with a portion of the main reflector cutaway.

Referring to FIG. 1, a lighting apparatus in accordance with the present invention is generally designated by the reference numeral 10. Lighting apparatus 10 includes light-emitting members 66; supplemental reflector member 62; and main reflector member 70 having an inner surface 72. It is contemplated that light-emitting member 66 take the form of a plurality of compact fluorescent lamps. However, other types of illumination devices may be utilized as light-emitting members 66 without deviating in scope from the present invention.

Figure 2:
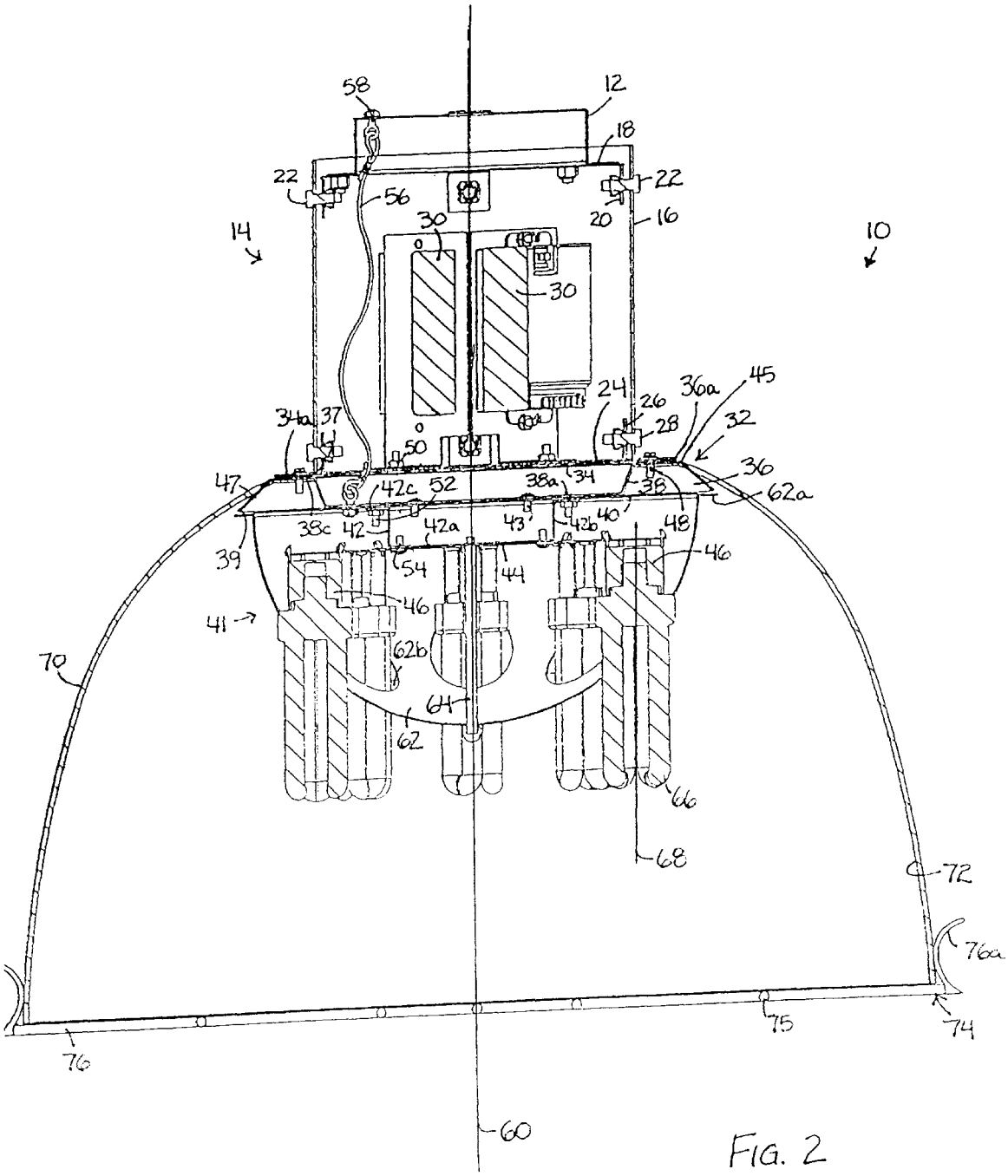
FIG. 2 is a cross-sectional side view of the lighting apparatus shown in FIG. 1.

As best seen in FIG. 2, lighting apparatus 10 includes a hanger bracket 12 for mounting lighting apparatus 10 on a suitable support structure such as a ceiling, wall or the like. A generally box-shaped ballast housing 14 depends from hanger bracket 12 and is defined by four side walls 16. Ballast housing 14 has a first end closed by hanger bracket mounting plate 18 to which hanger bracket 12 is attached. Hanger bracket mounting plate 18 has mounting flanges 20 which depend from the outer peripheral edge thereof and which are received within the ballast housing 14. Mounting flanges 20 of hanger bracket mounting plate 18 are fastened to side walls 16 of ballast housing 14 by a plurality of screws 22.

Ballast housing 14 is closed at a second end by a ballast support plate 24. Ballast support plate 24 has mounting flanges 26 which depend from the outer peripheral edge thereof. Ballast support plate 24 is dimensioned to be received within the ballast housing 14 such that mounting flanges 26 may be fastened to side walls 16 of ballast housing 14 by a plurality of screws 28. It is contemplated to mount ballasts 30 on ballast support plate 24 for reasons hereinafter described.

Mounting assembly 32 is interconnected to ballast support plate 24 for supporting light-emitting members 66. Mounting assembly 32 includes a flat, annular cover plate 34 interconnected to the ballast support plate 24 by bolts 50. Cover plate 34 includes a mounting portion 34*a* which projects laterally from side walls 16 of ballast housing 14. Mounting assembly 32 further includes backing plate 40 for supporting illumination structure 41. Safety wire 56 has a first end secured to hanger bracket 12 and a second end secured to backing plate 40 by eye-bolts 58 to prevent unintentional disassembly of lighting apparatus 10. Backing plate 40 is axially spaced from cover plate 34 by a shroud member spacer 38. Shroud member spacer 38 includes a flat mounting portion 38*a* adjacent and interconnected to backing plate 40 by bolts 43 and a mounting flange 38*c* which projects radially from primary axis 60. Mounting flange 38*c* of shroud member spacer 38 is interconnected to and axially spaced from the radially outer edge of flat mounting portion 38*a* by side walls 38*b* of shroud member spacer 38.

Mounting assembly 32 further includes a shroud member 36 having an inner end 37 defining an opening and an outer end 39 adjacent the radially outer end of backing plate 40 and flange portion 36*a*. Flange portion 36*a* extends radially outward from inner end 37 of shroud member 36 and terminates at an outer edge 45. Shroud portion 47 extends between outer edge 45 of flange portion 36*a* and outer end 39. In the preferred embodiment, shroud portion 47 is generally arcuate in shape. Flange portion 36*a* of shroud member 36 is interconnected to mounting assembly 32 by fasteners 48 which extend through mounting portion 34*a* of cover plate 34 and through mounting flange 38*c* of shroud member spacer 38 so as to capture flange portion 36*a* of shroud member 36 therebetween.

Lighting apparatus 10 extends along a centrally located primary axis 60. Main reflector member 70 is generally bell-shaped and symmetrical, having a first end defining an aperture dimensioned slightly larger than the dimension of cover plate 34 and a second end having a dimension greater than the first end to allow main reflector member 70 to rest on shroud portion 47 of shroud member 36. Alternatively, main reflector member 70 may include a flange portion to facilitate attachment to mounting assembly 32 to allow mounting of lighting apparatus in any orientation.

Illumination structure 41 includes a socket spacer 42 having a flat mounting portion 42*a* with two side members 42*b* depending therefrom and flange portion 42*c* laterally-extending from side members 42*b*. Socket spacer 42 is adjacent to and interconnected with backing plate 40 and shroud member spacer 38 by bolts 52. Illumination structure 41 further includes a generally flat, annular socket plate 44 on which sockets 46 are mounted. Socket plate 44 is interconnected to socket spacer 42 by screws 54. Mounting assembly 32 and illumination structure 41 further include electric wiring apertures therethrough (not shown) to allow ballasts 30 to be electrically interconnected to sockets 46.

Supplemental reflector member 62 is attached to socket spacer 42 by a fastener 64. As shown, fastener 64 is a bolt of sufficient length to engage a threaded hole (not shown) in socket spacer 42. The head of the bolt can be decorative) but it is preferred to be countersunk to present a continuous surface with supplemental reflector member 62. Supplemental reflector member 62 has apertures 62*b* through which light-emitting members 66 (preferably compact fluorescent lamps), can be inserted to engage corresponding electric sockets 46. The present invention may be used with any natural or artificial light source and has the ancillary benefit of having exemplary heat shield properties for fixtures utilizing high-heat producing lamps such as incandescent or metal-vapor lamps. For electrical economy, compact fluorescent lamps are highly preferable.

Supplemental reflector member 62 is generally convex in shape and includes a laterally-extending flange portion 62*a*. In the preferred embodiment shown, supplemental reflector member 62 is hemispherical in shape, but various other generally convex shapes can be used depending on the mounting structure for the lamps, the area to be illuminated, the shape of the main reflector, and other factors. One alternative is to have a truncated hemispherical shape the central portion of which is flattened or modified to a different curvature. Still another alternative embodiment has a supplemental reflector with an annular, generally flat outer area through which the lamps extend, completely exposing the light-emitting portions of the lamps, and a central convex region having a smaller radius than that of the hemispherical shape shown in the drawings. It can be appreciated that many other variations are possible for the shape of the supplemental reflector member without deviating from the scope of the present invention.

Figure 5:
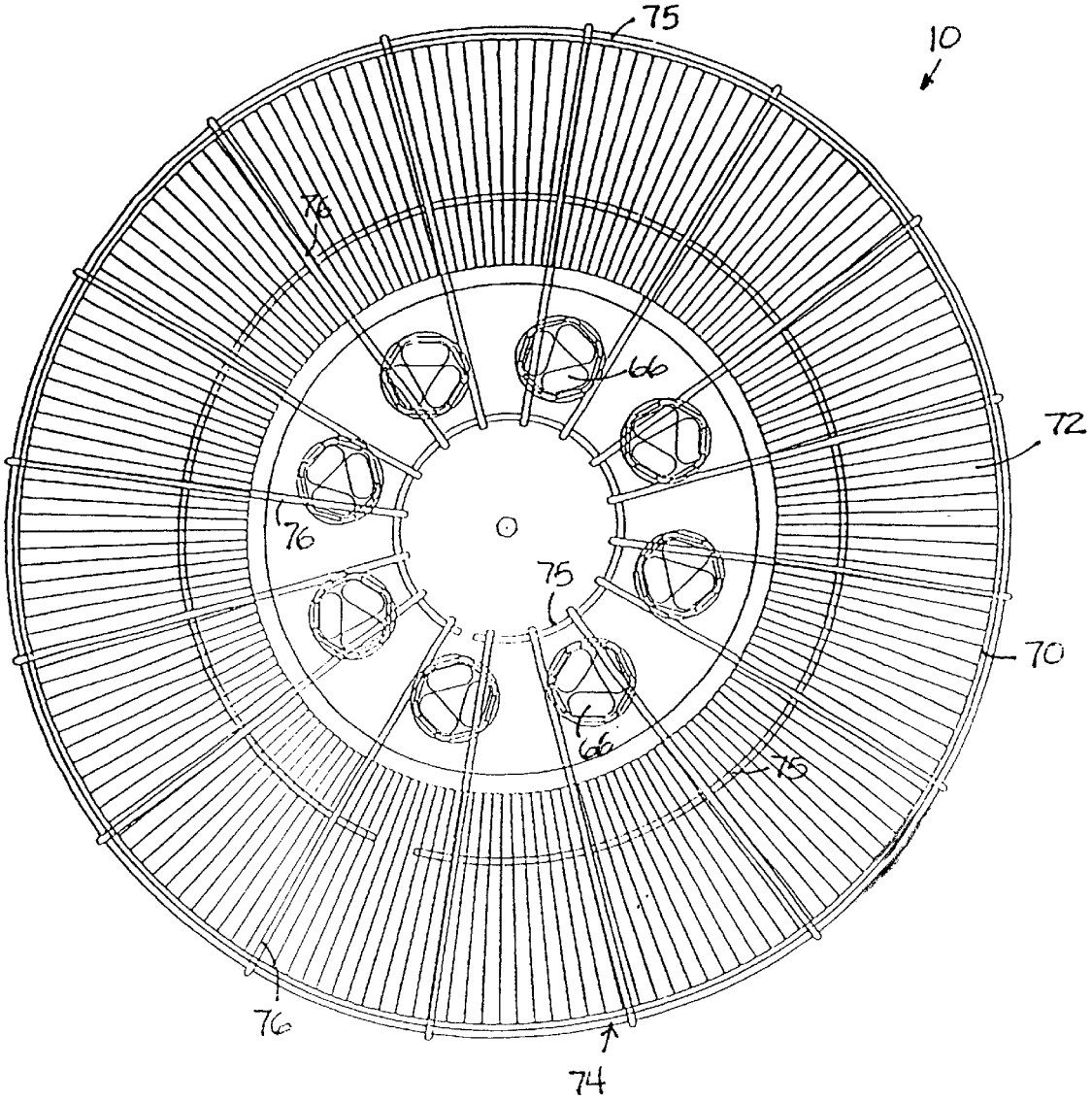
FIG. 5 is a bottom view of the lighting apparatus of FIG. 1 with a protective grid.

Light-emitting members 66 extend along corresponding axes 68. In a preferred embodiment axes 68 of light-emitting members 66 are parallel with each other and with primary axis 60 of main reflector member 70 (FIGS. 1, 2 and 5). A first advantage is that supplemental reflector member 62 may be removed easily from socket spacer 42 by releasing fastener 64 without the need to remove compact fluorescent lamps 66 from their respective sockets 46. This feature is of particular significance if one of the compact fluorescent lamps 66 was to break within its socket 46. Another advantage of the arrangement is the ability to relamp through apertures 62*b* without removing supplemental reflector member 62.

Figure 3:
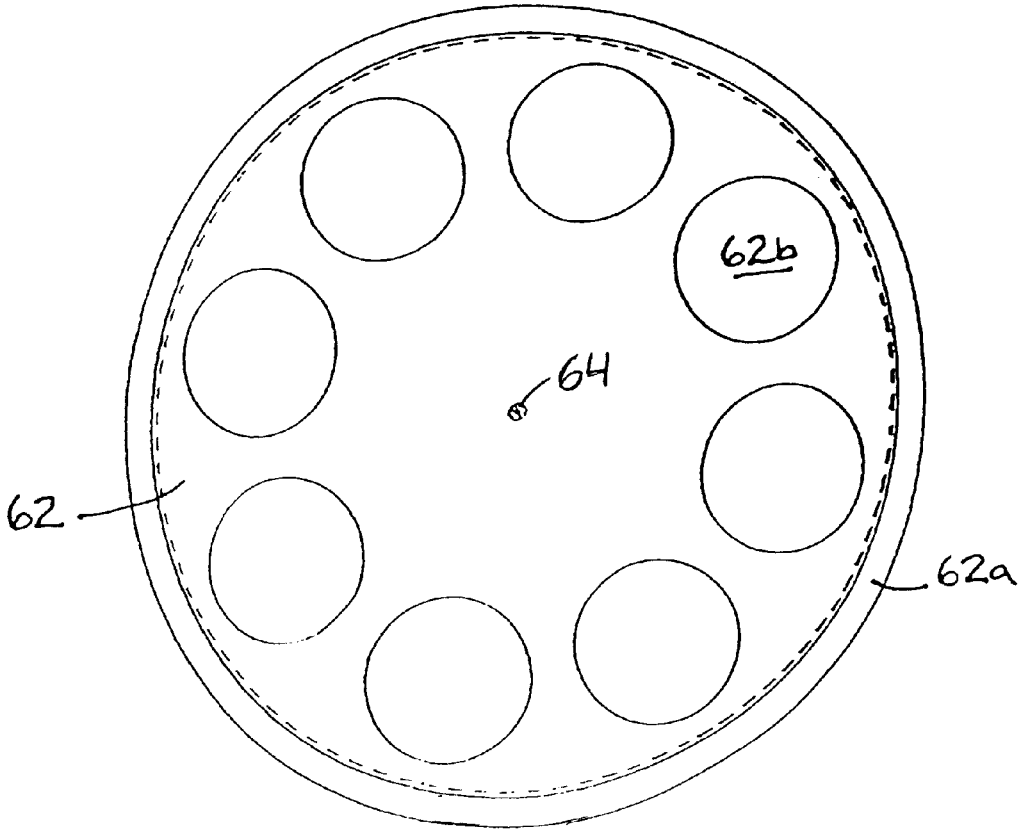
FIG. 3 is a bottom view of the supplemental reflector member of the lighting apparatus shown in FIG. 1.
Figure 4:
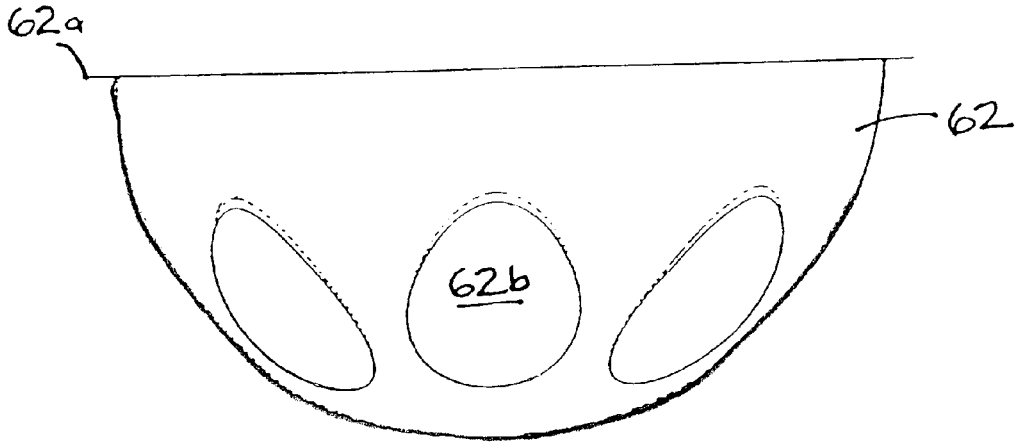
FIG. 4 is a side view of the supplemental reflector member of FIG. 3.

As best seen in FIGS. 3 and 4, apertures 62*b* of supplemental reflector member 62 are arranged in a preferred predetermined grid such that when light-emitting members 66 are inserted through respective apertures 62*b*, they provide a radially-symmetric arrangement. Radial symmetry is preferred in order that illumination received by the target area is uniform. It is preferable to use an even-number of light-emitting members 66, such as compact fluorescent lamps, and in particular eight such lamps. It is contemplated that by using eight compact fluorescent lamps 66, the ballasts 30 (FIG. 2) may be wired such that four-level switching (dimming) is possible. In such arrangement, four-level switching occurs by varying the number of lamps activated. The eight compact fluorescent lamps 66 are divided into four pairs. A pair consists of two lamps diametrically opposite each other. Intensity is varied by lighting one, two, three, or all four pairs.

Referring to FIG. 3, the shape of apertures 62*b* of supplemental reflector member 62 facilitate the removal of supplemental reflector member 62 without the necessity to remove compact fluorescent lamps 66 from their respective electrical sockets 46 (not visible). In addition, the shape of apertures 62*b* allows axes 68 of compact fluorescent lamps 66 to be parallel with each other and with primary axis 60 of main reflector member 70 when installed.

Referring to FIG. 5, main reflector member 70 is an acrylic prismatic reflector which is functional and is aesthetically pleasing. A protective grid 74 is attached to main reflector member 70 to protect compact fluorescent lamps 66. Protective grid 74 may include concentric rings 75 interconnected with a plurality of radially-extending spokes 76. Referring to FIG. 2, at least two of the radially-extending spokes 76 include retainer portions 76*a* for attaching protective grid 74 to main reflector member 70. Retainer portions 76*a* are generally arcuate in shape and are secured to main reflector member 70 by compression forces. It is contemplated that other structures, such as a prismatic lens (not illustrated) may protect the light-emitting members without deviating from the scope of the present invention.

Figure 6:
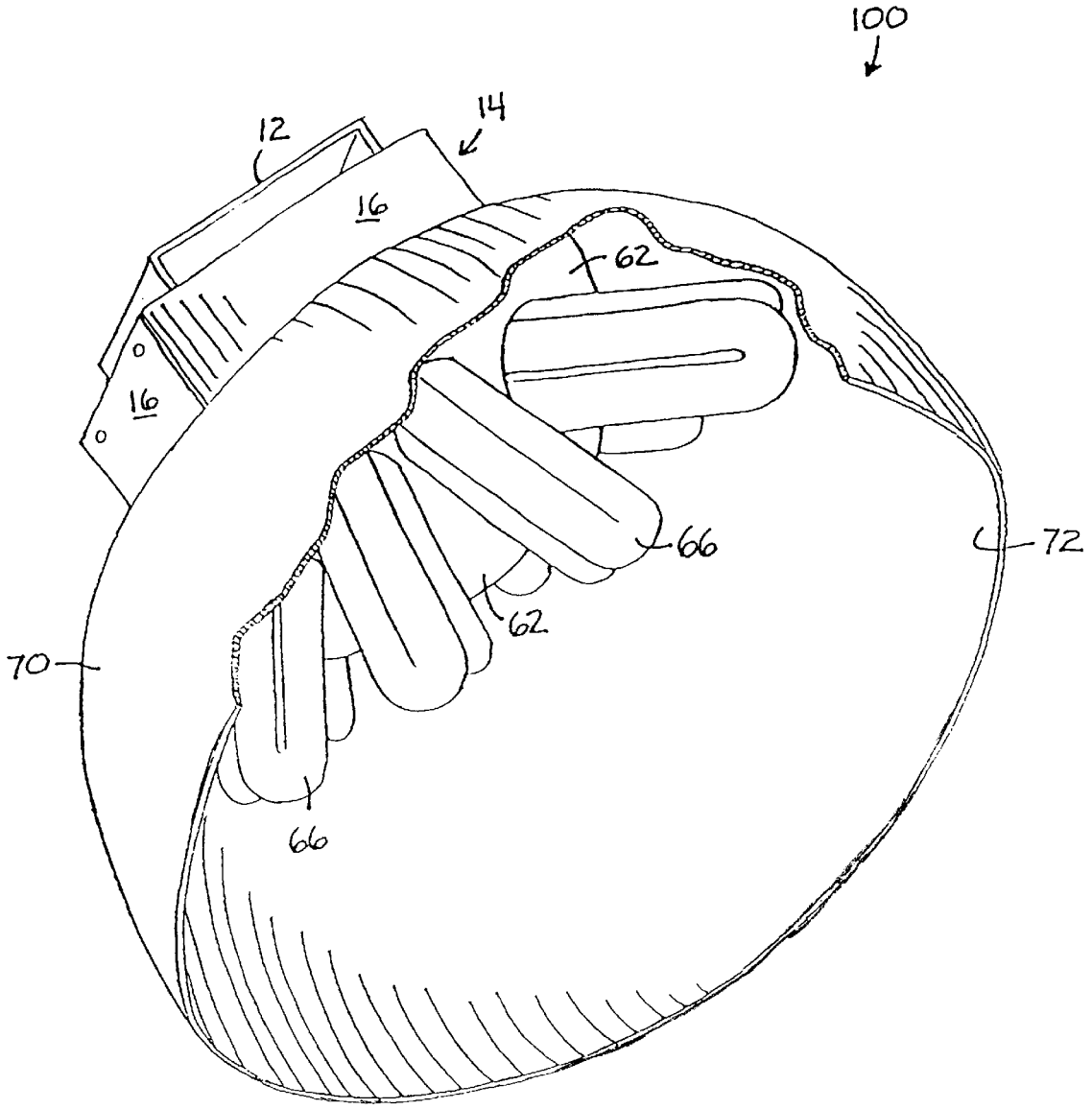
FIG. 6 is a perspective view of another preferred embodiment of the invention with a portion of the main reflector cutaway.

FIGS. 6 illustrates another embodiment in accordance with the present invention and is generally designated by the reference numeral 100. The elements of lighting apparatus 100 are identical as those of lighting apparatus 10, and as such, it can be appreciated that the prior description of lighting apparatus 10 fully describes lighting apparatus 100, with common reference characters being used except as otherwise provided hereinafter.

In lighting apparatus 100, compact fluorescent lamps 66 are arranged such that they extend radially from the surface of supplemental reflector member 62 and are not parallel with primary axis 60. This arrangement allows the full length of the light-emitting portion of the lamps to be exposed for illumination generation, while supplemental reflector member 62 retains its light-reflection and electrical socket-hiding benefits.

In operation, power is supplied to ballasts 30 which are wired and configured to correspond to pairs of compact fluorescent lamps 66 such that pairs of diametrically-opposed lamps operate simultaneously. In the preferred embodiment, there are four pairs of compact fluorescent lamps 66 which would provide four levels of illumination. Light from compact fluorescent lamps 66 will exit main reflector member 70 directly or will be reflected. A portion of the reflected fight will reflect off inner surface 72 of main reflector member 70 and exit main reflector member 70. A still further portion of the reflected light will reflect off supplemental reflector member 62 and will either directly exit the main reflector member 70 or be further reflected from the main reflector member 70 off inner surface 72. Main reflector member 70 may be made of any suitable material such that it possesses an inner reflective surface 72. Examples of materials suitable to provide inner surface 72 include polished metal, enameled metal, glass, or acrylic. The surface of supplemental reflector member 62 is highly reflective. In the most preferred embodiment, it is spun aluminum.

While the principles of this invention have been described in connection with specific embodiments, it should be understood that these descriptions are made only by way of example and are not intended to limit the scope of the invention.

What is claimed is:

1. A lighting apparatus comprising:

a main reflector member having a base end, an open end remote from the base end, a primary axis, and an inner reflective surface for reflecting light through the open end to an area to be illuminated;

a supplemental reflector member, smaller than the inner surface of the main reflector member, with a reflective, outer surface, removably attached with respect to the inner surface of the main reflector member;

a light source configured and arranged such that a portion of the source is exterior to the outer surface and such that a portion of the light emitted from the source will be reflected by the supplemental reflector member to the inner reflective surface of the main reflector member.

2. The lighting apparatus of claim 1 wherein the supplemental reflector member has a convex reflective surface.

3. The lighting apparatus of claim 2 wherein the light source is an electrically-generated light source having:

at least one light-emitting member with an electrical connector;

an electricity source with at least one socket to receive the electrical connectors of the at least one light-emitting member, attached with respect to the main reflector member.

4. The lighting apparatus of claim 3 wherein the supplemental reflector member has at least one aperture through which the electrical connector of the at least one light-emitting member may be inserted to removably engage the at least one socket, whereby when engaged with the at least one light-emitting member, the at least one socket is shielded from view by the at least one light-emitting member and the supplemental reflector member.

5. The lighting apparatus of claim 4 wherein a plurality of apertures are spaced apart on the surface of the supplemental reflector member in a pre-determined grid pattern.

6. The lighting apparatus of claim 4 wherein the at least one light-emitting member is a compact fluorescent lamp.

7. The light apparatus of claim 6 wherein:

the light source is a plurality of compact fluorescent lamps, each having an axis, the electricity source has a plurality of sockets at least equal in number to the plurality of compact fluorescent lamps, a number of apertures is at least equal to the number of sockets.

8. The light apparatus of claim 7 wherein the sockets are configured and arranged such that the axes of the compact fluorescent lamps are parallel with each other when the compact fluorescent lamps are engaged with the sockets.

9. The light apparatus of claim 8 wherein the axes of the compact fluorescent lamps are parallel with the primary axis of the main reflector member.

10. An improved lighting apparatus having:

a main reflector member with a base end of a first size and a light-emitting end, remote from the base end, of a second size larger than the first size, a base member attached to the inner end of the main reflector member, a plurality of compact fluorescent lamps removably engaged with respect to the base member, an electric power supply for supplying power to the lamps engaged with respect to the base member, wherein the improvement comprises:

a supplemental reflector member with a outer convex reflective surface, removably attached with respect to the base member and located within the main reflector member, the supplemental reflector member having apertures through which the lamps can be removably engaged with respect to the base member, configured and arranged such that a portion of light emitted from the lamps will be directly incident to and reflected from the outer surface of the supplemental reflector member to the main reflector member for reflection onto an area to be illuminated.

11. A lighting apparatus of the open-ended type without a diffuser comprising:

a main reflector member having a primary axis and an inner reflective surface for reflecting light to an area to be illuminated;

a supplemental reflector member, smaller than the inner surface of the main reflector member, removably attached with respect to the inner surface of the main reflector member;

a light source configured and arranged such that a portion of the light emitted from the source will be reflected by the supplemental reflector member to the inner reflective surface of the main reflector member.

12. The lighting apparatus of claim 11 wherein the supplemental reflector member has a convex reflective surface.

13. The lighting apparatus of claim 12 wherein the light source is an electrically-generated light source having:

at least one light-emitting member with an electrical connector;

an electricity source with at least one socket to receive the electrical connector of the at least one light-emitting member, attached with respect to the main reflector member.

14. The lighting apparatus of claim 13 wherein the supplemental reflector member has at least one aperture through which the electrical connector of the at least one light-emitting member may be inserted to removably engage the at least one socket, whereby when engaged with the at least one light-emitting member, the at least one socket is shielded from view by the at least one light-emitting member and the supplemental reflector member.

15. The lighting apparatus of claim 14 wherein a plurality of apertures are spaced apart on the surface of the supplemental reflector member in a pre-determined pattern.

16. The lighting apparatus of claim 14 wherein the at least one light-emitting member is a compact fluorescent lamp.

17. The light apparatus of claim 16 wherein:

the light source is a plurality of compact fluorescent lamps, each having an axis, the electricity source has a plurality of sockets at least equal in number to the plurality of compact fluorescent lamps, a number of apertures is at least equal to the number of sockets.

18. The light apparatus of claim 17 wherein the sockets are configured and arranged such that the axes of the compact fluorescent lamps are parallel with each other when the compact fluorescent lamps are engaged with the sockets.

19. The light apparatus of claim 18 wherein the axes of the compact fluorescent lamps are parallel with the primary axis of the main reflector member.

* * * * *